US005827994A

United States Patent [19]

Gladden et al.

[11] Patent Number: 5,827,994

[45] Date of Patent: Oct. 27, 1998

[54] FISSILE SHOCK TUBE AND METHOD OF MAKING THE SAME

[75] Inventors: Ernest L. Gladden, Granby; Robert G. Pallanck, Windsor, both of Conn.

[73] Assignee: The Ensign-Bickford Company, Simsbury, Conn.

[21] Appl. No.: 678,106

[22] Filed: Jul. 11, 1996

[51] Int. Cl.[6] ..... C06C 5/04

[52] U.S. Cl. ..... 102/275.8; 102/275.1; 86/1.1; 86/20.1

[58] Field of Search ..... 102/275.1, 275.5, 102/275.6, 275.8, 275.9; 86/1.1, 20.1, 21, 22

[56] References Cited

U.S. PATENT DOCUMENTS

| | | |
|---|---|---|
| 1,371,034 | 3/1921 | Leblanc . |
| 2,102,024 | 12/1937 | Pearsall . |
| 3,374,737 | 3/1968 | Pike . |
| 3,590,739 | 7/1971 | Persson . |
| 3,712,222 | 1/1973 | Richardson et al. . |
| 4,024,817 | 5/1977 | Calder, Jr. et al. . |
| 4,220,087 | 9/1980 | Posson . |
| 4,328,753 | 5/1982 | Kristensen et al. . |
| 4,516,501 | 5/1985 | Held et al. . |
| 4,607,573 | 8/1986 | Thureson et al. . |
| 4,608,113 | 8/1986 | Miller ..... 102/275.1 |
| 4,699,059 | 10/1987 | Kelly et al. . |
| 4,753,170 | 6/1988 | Regalbuto et al. . |
| 4,756,250 | 7/1988 | Dias dos Santos . |
| 4,838,165 | 6/1989 | Gladden et al. . |
| 5,001,981 | 3/1991 | Shaw . |
| 5,007,661 | 4/1991 | Lenzen . |
| 5,010,821 | 4/1991 | Blain . |
| 5,020,435 | 6/1991 | Cawte . |
| 5,166,470 | 11/1992 | Stewart . |
| 5,171,935 | 12/1992 | Michna et al. . |
| 5,212,341 | 5/1993 | Osborne et al. . |

FOREIGN PATENT DOCUMENTS

| | | |
|---|---|---|
| 1200718 | 2/1986 | Canada . |
| 2107022 | 4/1994 | Canada . |
| 0327219 | 8/1989 | European Pat. Off. . |
| 3810355 | 10/1989 | Germany . |
| 2027176 | 2/1980 | United Kingdom . |
| 2255160 | 10/1992 | United Kingdom . |
| 8808414 | 11/1988 | WIPO . |

*Primary Examiner*—Harold J. Tudor
*Attorney, Agent, or Firm*—Law Offices of Victor E. Libert; Frederick A. Spaeth

[57] ABSTRACT

An initiation signal transmission line tube (10*a,* 10*b,* 10', etc.), which is effective to transmit an initiation signal therethrough, contains one or more rupture lines (20*a,* 20*b* and 20*c,* etc.) in the tube wall. Rupture lines (20*a,* 20*b* and 20*c,* etc.), which may be weld seams or grooves or both, are ruptured by the initiation signal passing therethrough. The spent tube carcass is split or fragmented and therefore less troublesome as litter on a work site than an intact shock tube carcass. If the tube is extruded, a rupture line may be formed by contacting the parison (118) from which the tube is made with scoring means, e.g., a pin or blade (124*a,* 124*b*). Optionally, the scoring means may be moved radially during the extrusion process, to form serpentine, e.g., helical, rupture lines. Preferably, the rupture lines intersect periodically and, upon firing, the tube is fragmented into shards. Alternatively, the tube (50*d*) may be extruded in segments (62) that adhere to each other at interfaces (64) which provide rupture lines for the tube. Optionally, some segments (62) may be formed from different extrudate materials than others.

28 Claims, 5 Drawing Sheets

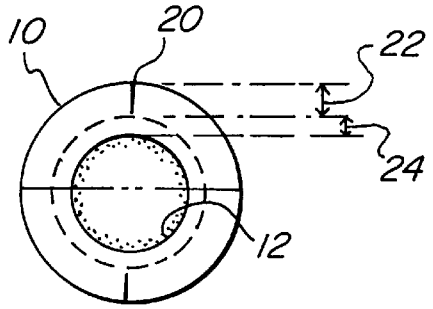
FIG. 2D
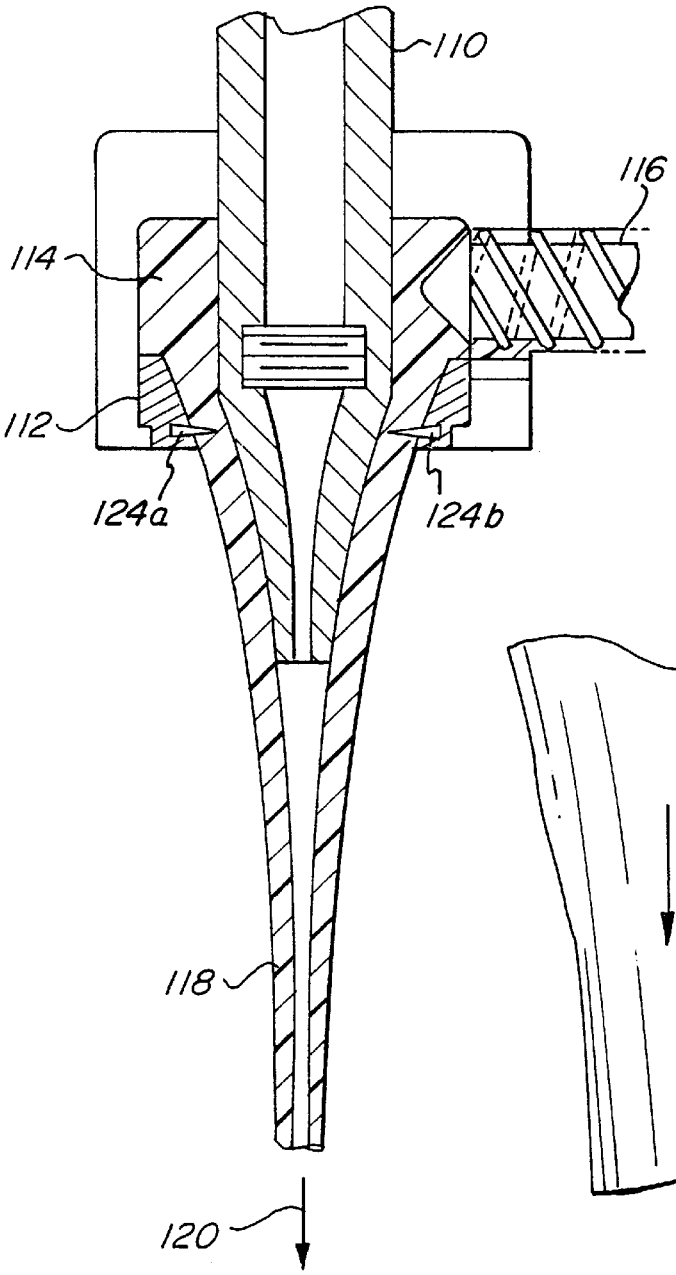
FIG. 2E
FIG. 2C
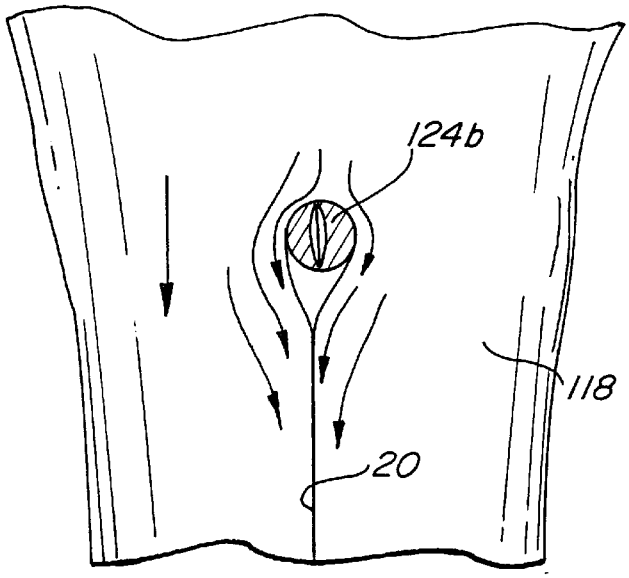

FISSILE SHOCK TUBE AND METHOD OF MAKING THE SAME

BACKGROUND OF THE INVENTION

Field of the Invention

This invention relates to initiation signal transmission lines used in mining and other blasting operations, and in particular to initiation signal transmission lines comprising tubular members, e.g., shock tube.

It is conventional practice in mining and other blasting operations to employ non-electric initiation signal transmission lines to transmit initiation signals from an ignitor device to a detonator that is used to set off an explosive charge such as a borehole explosive charge. Two well-known types of non-electric signal transmission line are known in the art as shock tube and low velocity signal transmission tube, and are referred to collectively as signal transmission tubes. Typically, a signal transmission tube comprises a flexible but resilient tube having a thin layer of reactive powder material adhered to the inner wall, leaving a continuous open channel along the length of the tube.

Generally, a signal transmission tube may be formed from an extruded synthetic polymeric material such as EAA (ethylene/acrylic acid copolymer), EVA (ethylene vinyl acetate) or a SURLYN™ such as SURLYN™ 8940, an ionomer resin available from E. I. DuPont de Nemours Company, low density polyethylene (LDPE), linear low or medium density polyethylene, linear low, medium and high density polyester and polyvinylidene chloride (PVC), and suitable blends or polymer alloys of such materials. A signal transmission tube may comprise multiple, concentric, co-extruded layers, the outer layer or layers usually being made of a mechanically tougher polymer than the innermost layer. The material used to manufacture the signal transmission tube is generally chosen so that the finished tube will be sufficiently flexible to permit the necessary handling, but will also be of sufficiently high tensile strength and resiliency to resist breakage and sufficiently tough to resist abrasion, cutting or nicking of the tube during use. In fact, conventional signal transmission tubes are so resilient and strong that an initiation signal passing therethrough does not substantially affect the physical integrity of the tube, which remains intact after the signal passes therethrough. This allows signal transmission tubes to be used advantageously on the surface of a blasting site where air blast and associated noises are unwanted, as well as for the transfer of an initiation signal through explosive material (such as a borehole charge) to a detonator for the explosive material without causing premature detonation or disrupting the explosive charge in the borehole.

Basic shock tube construction is disclosed in U.S. Pat. No. 3,590,739 to Persson, dated Jul. 6, 1971. Persson discloses disposing a thin layer of pulverulent high brisance explosive material such as PETN, RDX, HMX or TNT on the interior wall of the tube. U.S. Pat. No. 4,328,753 to Kristensen et al, dated May 11, 1982, discloses a multilayer shock tube in that the inner layer is made from a plastic material suitable for use as adhesive film in order to help adhere the reactive powder thereto, the use of certain grades of SURLYN™ ionomer resins (available from E. I. DuPont de Nemours Company) is disclosed as being satisfactory for the purpose. The outer tube is made from a polymer such as a polyamide or the like to provide satisfactory mechanical properties. U.S. Pat. No. 4,607,573 to Thureson et al, dated Aug. 26, 1986, discloses multiple-layered shock tubes and a method of manufacturing the same.

U.S. Pat. No. 4,838,165 to Gladden et al, dated Jun. 13, 1989, discloses a low velocity signal transmission tube, the interior of which is coated with a reactive material comprising a deflagrating substance. Silicon/red lead and molybdenum/potassium perchlorate are but two of many such compositions listed in this patent.

Generally, shock tube contains a reactive material containing a high brisance explosive and has a propagation rate of the signal of about 2,000 meters per second (6,562 feet per second); low velocity signal transmission tube contains a deflagrating reactive material which provides a much lower signal propagation rate, typically about 760 meters per second (2500 feet per second).

One disadvantageous result of the resilience, toughness and tensile strength of conventional signal transmission tube such as shock tube is that after the blasting operation, the blasting area is littered with spent but intact tube carcass. The tube carcass may clog up mine processing equipment and may tangle in rotating parts of mining equipment such as the axles or shafts in earth-moving equipment and crushing machinery employed at the blasting site shortly after the tube is used, and may require frequent removal. For example, tube carcasses often snag on earth-moving equipment such as bulldozers, forcing the operator to stop the bulldozer to cut tube carcass from the equipment and to collect and remove tube carcass from the work site. On a longer time frame, those portions of conventional tube carcasses that remain on the blasting site or that are transported elsewhere constitute solid waste that is not very susceptible to biodegradation.

Accordingly, there is a need in the art for an initiation signal transmission tube that leaves behind a less resilient and less strong carcass after the blasting operation is complete.

U.S. Pat. No. 3,712,222 to Richardson et al, dated Jan. 23, 1973, discloses a pyrotechnic fuse made from a heat-shrinkable thermoplastic resin tube that contains a pyrotechnic mixture. In one embodiment of the invention illustrated in FIGS. 5 and 6 of the patent, the tubular casing has a grooved wall portion (34) (FIG. 6) which serves to guide a fracture orifice (22) (FIG. 5) that develops as the pyrotechnic mixture in the fuse burns. The orifice is described as providing an escape route for burning gases and vapors produced by the pyrotechnic material, which fills the entire tube interior, to keep the velocity of the flame front uniform and to provide a visual indication of the progress of the flame front (see column 4, lines 36–62). The pyrotechnic fuse in this patent is intended for slow burning applications, e.g., 35 seconds per inch to about 5 seconds per inch (see column 2, lines 50–53).

SUMMARY OF THE INVENTION

Broadly viewed, the present invention relates to an initiation signal transmission tube which is effective to transmit an initiation signal therethrough, but which will rupture or split upon the application of radial tension on the tube or the transmission of the pressure pulse therethrough, due to the presence of at least one rupture line in the tube wall. The rupture line, which may be, e.g., a weld seam or a groove or a combination of the two, allows the tube to split open or rupture, producing a fractured carcass that is less troublesome with respect to removal and disposal than conventional signal transmission tube carcasses.

Specifically, the present invention relates to a method for making a fissile signal transmission tube comprising (a) extruding at least one extrudate material to form a tube comprising a tube wall having an inner surface which defines an interior longitudinal passageway of the tube, (b) forming at least one longitudinally extending rupture line in the tube wall to provide a region of reduced bursting strength along the rupture line, and (c) disposing material within the interior longitudinal passageway of the tube in an amount sufficient to propagate an initiation signal therethrough and to rupture the tube along at least one rupture line.

According to one aspect of the invention, creating the at least one rupture line may comprise forming a weld seam in the tube wall. Forming a weld seam may comprise disposing a pin or blade in the flow path of the extrudate material. The extrudate material is allowed to flow past the blade and to converge downstream of the blade to form a tube having a longitudinally extending weld seam. Optionally, the blade may be vibrated, and/or heated or cooled to facilitate extrudate flow past the blade.

According to another aspect of the invention, forming at least one longitudinally extending rupture line may comprise forming at least one groove in the tube wall, e.g., on the interior surface of the tube, and disposing reactive material in the grooves. Optionally, grooves may be formed on the exterior surface of the tube.

Optionally, the method may comprise orbiting the scoring means about the centerline of the tube to form at least one serpentine rupture line in the tube wall, e.g., one or both of a helical rupture line and a sinusoidal rupture line.

In another aspect, the method may comprise creating at least two longitudinally extending rupture lines in the tube wall. Optionally, the at least two rupture lines may intersect at periodic, longitudinally spaced-apart intervals along the length of the tube.

In yet another aspect, the present invention relates to a signal transmission tube and a method for its manufacture that may comprise extruding a plurality of tube segments in an annular configuration to form the tube, with adjacent segments adhering to each other at interfaces that provide at least one rupture line. There may be a first plurality of tube segments and a second plurality of tube segments. The first plurality of tube segments may be dimensioned and configured to define the interior surface of the tube, and the second plurality of tube segments may define at least a portion of the exterior surface of the tube. Optionally, the method may comprise extruding at least two different extrudate materials.

The present invention also provides a fissile signal transmission tube comprising a tube wall having an inner surface and at least one longitudinally extending rupture line formed in the tube wall to provide a region of reduced bursting strength. A reactive material is disposed on the inner surface of the tube in an amount sufficient to propagate an initiation signal therethrough and to burst the tube along the at least one rupture line. Optionally, the rupture line may have a serpentine configuration.

According to one aspect of the invention, the tube wall may have formed therein at least two longitudinally extending rupture lines and, preferably, the rupture lines may intersect at periodic, longitudinally spaced-apart intervals along the length of the tube. In some embodiments, the at least two longitudinal rupture lines may both have serpentine, e.g., helical counter-rotating, configurations.

According to still another aspect of the invention, the tube in any of the foregoing embodiments may comprise an environmentally degradable material, and the tube may optionally comprise a protective outer casing on the degradable material to protect the degradable material prior to firing.

As used herein and in the claims, the term "serpentine" used to connote the configuration of a rupture line is used broadly to include helical configurations, sinusoidal configurations and any non-straight line configurations relative to the longitudinal axis of the tube.

BRIEF DESCRIPTION OF THE DRAWINGS

FIG. 2C is a partial elevational view, enlarged with respect to FIG. 2A, of the parison of FIG. 2A taken along line 2C—2C, showing the formation of a weld seam;

FIG. 2D is a cross-sectional view of a shock tube having a weld seam in accordance with one embodiment of the present invention;

FIG. 2E is a view similar to that of FIG. 2A of a die head according to an alternative embodiment of the present invention;

DETAILED DESCRIPTION OF THE INVENTION AND SPECIFIC PREFERRED EMBODIMENTS THEREOF

Figure 1:
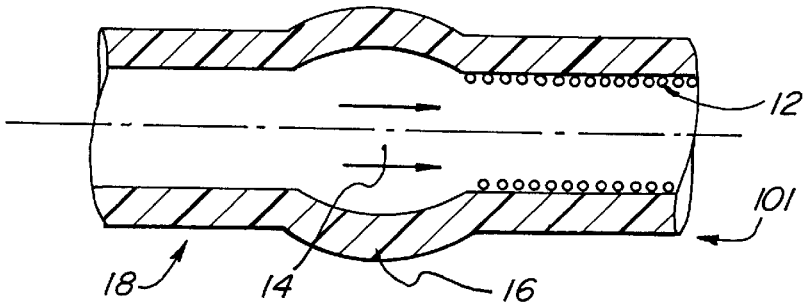
FIG. 1 (PRIOR ART)
FIG. 1 is a cross-sectional side view of a conventional shock tube according to the prior art.

As shown in FIG. 1, a conventional shock tube 101 has a coating of reactive material 12 on the inner wall of the tube. As is known in the art, reactive material 12 may comprise an explosive powder such as a mixture of HMX and aluminum in an amount of, for example, about 2.7 g/m$^2$ on the inner surface of the tube or, for example, about 0.01 g/linear meter of tube. As the detonation zone 14 of an initiation signal passes through the tube in the direction of the arrows (unnumbered), an associated pressure pulse causes a bulge 16 in the tube wall, as described in U.S. Pat. No. 3,590,739 to Persson. The bulge is due to a pressure wave caused by the detonation of reactive material 12 on the inner wall of tube 101, which is believed to produce a localized pressure pulse in the range of about 2000 to 4000 psi (140 to 280 kg/cm$^2$). The pressure pulse is essential for the transmission of the initiation signal through the tube. Shock tube 101 retains its physical integrity as bulge 16 passes along its length, substantially returning to the pre-firing configuration as indicated at carcass region 18. Thus, the intact resilient tube remains as a carcass once the tube is fired. It has hither to been assumed that the tube must be sufficiently resilient and strong to remain intact after the signal passes therethrough to assure that the signal will propagate through the tube. As described above, an intact signal transmission tube carcass poses handling and environmental problems at the worksite.

One aspect of the present invention derives from the realization that the-tube wall need not be so resilient that it remains intact after the transmission of an initiation signal pulse therethrough. The applicants have realized that an initiation signal tube may comprise a fissile tube which is effective to reliably transmit an initiation signal, but which will nonetheless be ruptured by the accompanying pressure pulse or wavefront due to the presence of at least one rupture line in the tube wall. The at least one rupture line, which may comprise, e.g., one or more weld seams or grooves or a combination of the two, weakens the tube wall and allows the tube to split or rupture when the initiation signal passes therethrough, producing a fractured carcass that is more susceptible to biodegradation and/or environmental degradation, and is less physically resilient, than conventional intact signal transmission tube carcasses. A tube carcass that is split open along even a single rupture line according to the present invention is more susceptible to such degradation than an intact tube carcass simply because it has a greater exposed surface area. This advantage increases, of course, with additional rupture lines. Biodegradation will be accelerated by the use of biodegradable polymeric materials, as described below. In various embodiments, a fissile tube according to the present invention may comprise two or more rupture lines along which the tube ruptures when the initiation signal passes therethrough. If the rupture lines do not intersect one another, the tube carcass is split into at least two separate longitudinal strips, each significantly more pliable and less strong and resilient than the intact tube carcass would be. Also, when tensile forces are applied unevenly among the strands, as can easily happen when tangled carcasses are stretched by earth moving equipment, the strands break more easily than an intact carcass. The split carcass is therefore less of a hindrance for moving equipment on the blasting site relative to an intact carcass. When the rupture lines intersect, causing the tube to burst into shards, susceptibility to biodegradation is enhanced and interference with earth moving equipment and the like is substantially reduced or eliminated. The rupture line or lines do not so weaken the tube wall, however, that the tube ruptures prematurely, e.g., during on-site handling.

The coreload of reactive material powder in such tube may need to be greater than that required for mere signal propagation. The coreload should not, however, be so great as to cause problematic migration of the reactive material powder in the tube before it is initiated. The coreload of reactive material that will transmit a signal through, as well as split, a shock tube comprising linear, low density or medium density polyethylene and having an inner diameter of 0.045 inch (1.14 mm) and an outer diameter of 0.118 inch (3 mm), is about 8 to 30 milligrams per meter ("mg/m"), preferably 10 to 25 mg/m. At coreloads less than about 8 mg/m, such a tube may not split reliably, and above about 30 mg/m, there may be excessive migration of the reactive material powder. The requisite coreload of reactive material will vary with varying tube thicknesses, materials, etc., but can be easily determined by one of ordinary skill in the art on the basis of the teachings and examples provided herein.

A fissile signal transmission tube may be produced by modifying a conventional extrusion method for producing the tube to provide scoring means for forming at least one rupture line in the tube In one embodiment, the scoring means comprises at least one blade or pin mounted in or near the extrusion die so that it extends into the tube wall while the extruded material is still in fluid form. The extrudate flows around the pin and then reconverges to weld itself together, but the pin is disposed so that the extruded material does not fully "heal", but rather cools to its finished state with an internal weld seam of diminished resiliency formed in the tube wall, providing a rupture line. The resulting tube has a tube wall that may superficially resemble a conventional homogeneous tube wall and is sufficiently resilient and strong to withstand the stresses of handling, emplacement and connection at the blasting site and to transmit an initiation signal therethrough, but the tube will rupture along the weld seam or rupture line as the signal passes through the tube. Subjecting the blade to ultrasonic vibration, and/or heating or cooling the blade, may facilitate the smooth flow of extrudate past the blade. In other embodiments the rupture line is a groove that is formed into the tube by scoring means such as a ribbed or a fluted extrusion die, or a scoring tine mounted on or near the extrusion die so that it bears upon the extruded tube to form a groove therein. The longitudinally extending rupture line may be substantially straight or may have a serpentine, e.g., helical or sinusoidal, configuration.

The extrudate material that forms the tube may comprise any suitable polymeric material, such as any of those indicated above. Typically, the material has a molecular orientation in the direction of the tube length as a result of the extrusion process. This orientation can be enhanced by stretching the tube after extrusion. Such an orientation enhances tensile strength of the tube while reducing the burst strength.

Alternatively, rather than disposing a pin or blade in the parison or scoring the tube, the extruder could be configured to extrude a plurality of parallel tube segments that are brought together in an annular configuration while hot so that they adhere to one another without fully melding. Thus, the interfaces between adjacent segments will be weaker than the remainder of the tube wall and will thus provide rupture lines in the tube wall. The segments may comprise like or different polymeric materials.

Figure 2A:
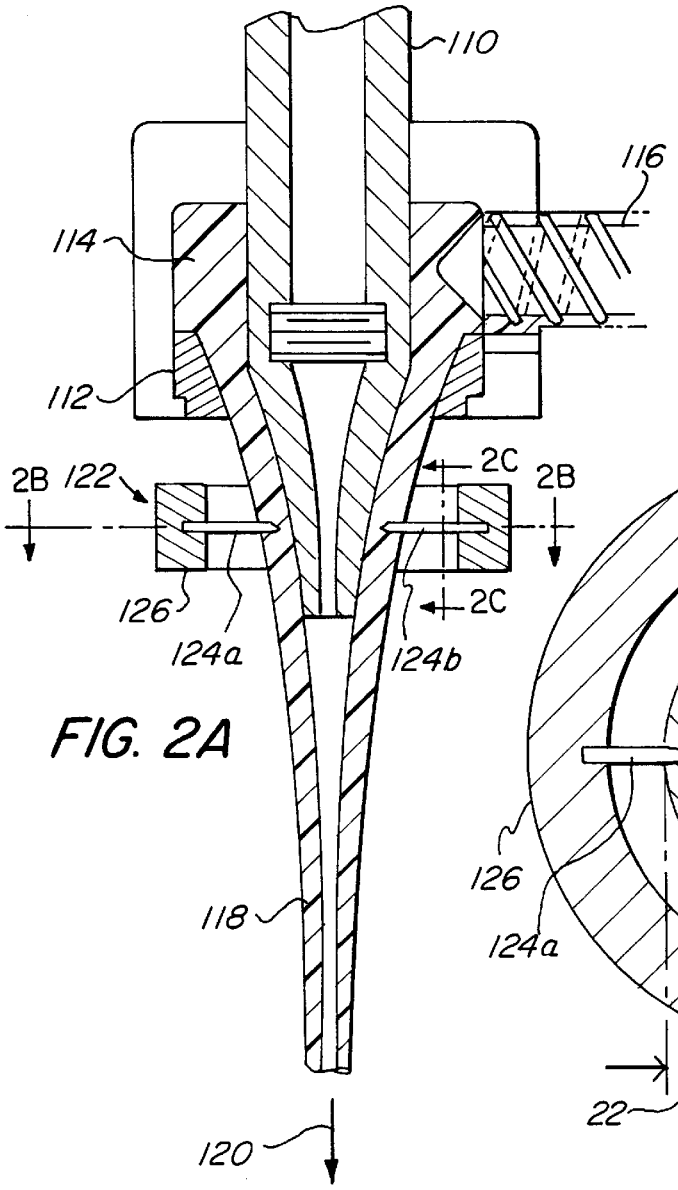
FIG. 2A is a schematic cross-sectional view of the die head of an extrusion apparatus showing a parison being extruded therethrough for producing one embodiment of a shock tube according to the present invention.

A fissile signal transmission tube comprising an extruded tube may be produced in accordance with one method aspect of the present invention by disposing scoring means comprising a stationary blade or pin on the extrusion die. For example, as shown in FIG. 2A, an extrusion die for manufacturing shock tube may comprise a pencil die 110 and a ring die 112, between which fluid polymeric extrudate 114 is forced by a conventional feed mechanism that may comprise an extruder screw 116. As extrudate 114 flows past ring die 112 and pencil die 110 to form parison 118, parison 118 is pulled, by means not shown, in the direction of arrow 120 to be stretched and drawn down into a continuous length of tube. Reactive material (not shown) is fed through the interior of the pencil die to be deposited on the interior tube wall. Parison 118 flows through a fixture 122 which includes scoring means comprising, in the illustrated embodiment, two pins or blades 124*a*, 124*b* (hereinafter referred to as "pins") that protrude from a mounting ring 126 into parison 118 to form weld seams. The pins extend into parison 118 to a depth 22 shown in FIG. 2B, leaving, in the illustrated embodiment, an unpenetrated radial portion 24.

Figure 2B:
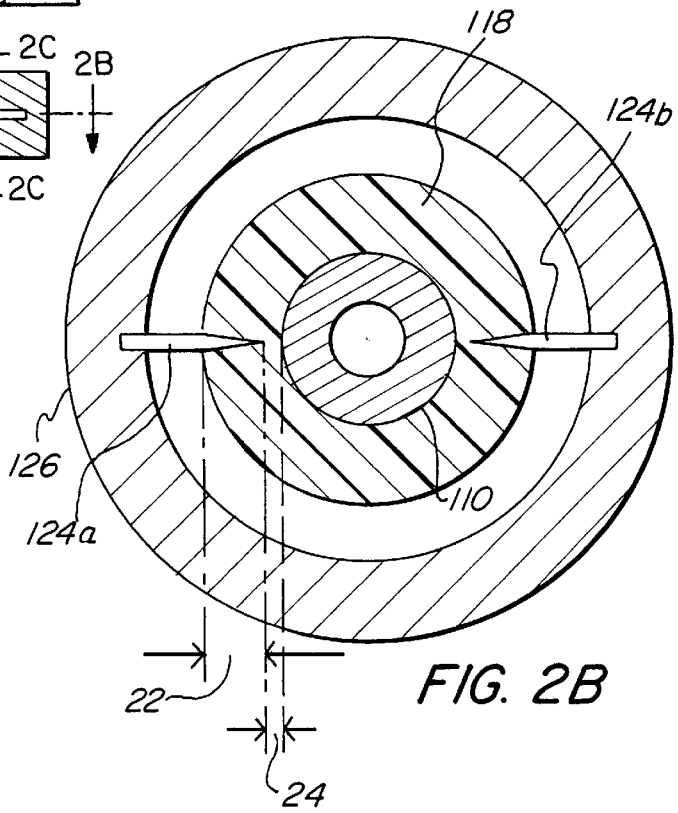
FIG. 2B is a cross-sectional view of the apparatus of FIG. 2A taken along line 2B—2B.

Each pin 124*a*, 124*b* is disposed in contact with the tube when the tube is being extruded so that, as seen in FIG. 2C, the parison wall is severed longitudinally as the extrudate is forced to flow around the pins. The severed parison wall reconverges as it passes the pins (without fully healing) to a degree sufficient to form a closed tube having a pair of substantially straight longitudinally extending weld seams 20 formed in the wall of the tube. Weld seams 20 of the illustrated embodiment provide rupture lines in the product shock tube along which the tube splits when fired. Preferably, each pin 124*a*, 124*b* is attached to a fixture at a point external to the tube and extends only part of the way into the wall of the tube as shown in FIGS. 2A and 2B. In other embodiments, the scoring means, e.g., pins, may extend into the tube wall from the interior of the tube, or may extend through the entire thickness of the wall, provided they do not create so much drag on the extrudate that the flow is broken, and provided the resulting wall has adequate strength for propagating a signal therein and for remaining intact during pre-firing handling.

A rupture line in a finished tube, e.g., weld seam 20 of tube 10 of FIG. 2D, establishes a longitudinal line of weakness along the tube so that as reactive material 12 reacts, the associated pulse will rupture the tube along weld seam 20. Nevertheless, the combined strength of the partially healed weld seam 20 and any unsevered portion 24 (FIGS. 2B and 2D) is sufficient to maintain the pulse and propagate the initiation signal through the tube. In a particular embodiment, the tube may be made from materials such as SURLYN™ 8941 and may have an outside diameter of about 0.059 to 0.200 inch (1.5 to 5.1 millimeters ("mm")), an inside diameter of about 0.020 to 0.0985 inch (0.5 to 2.5 mm) and a wall thickness of about 0.051 to 0.0985 inch (1.3 to 2.5 mm) with a loading of about 5 to 50 mg per linear meter of reactive material on the inner wall of the tube. In such a tube, weld seam 20 may extend to a depth 22 corresponding to about 80% of the wall thickness. In other embodiments the weld seam may extend through the entire wall thickness.

In an alternative extruder die configuration shown in FIG. 2E, pins 124*a*, 124*b* are mounted in ring die 112 and extend towards pencil die 110. Since ring die 112 is stationary, the apparatus of FIG. 2E will produce a shock tube having substantially straight, non-intersecting rupture lines. Conversely, pins 124*a*, 124*b* could be mounted on pencil die 110 so that they extend into parison 118 towards ring die 112.

Figure 2F:
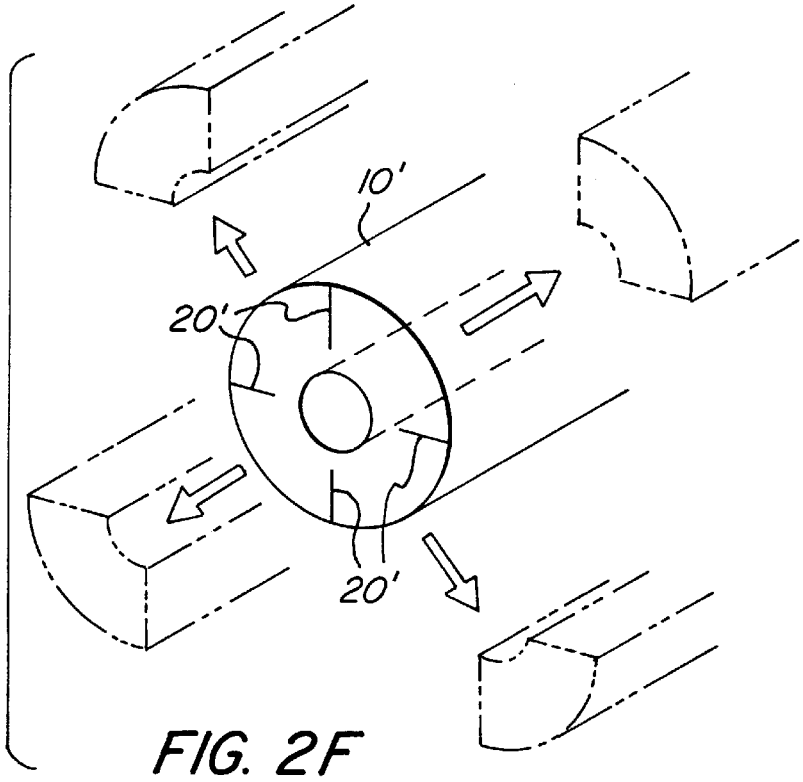
FIG. 2F is a partly cross-sectional perspective view of a shock tube according to one embodiment of the invention, showing in dottled outline the longitudinal strands into which the tube will split upon firing.

FIG. 2F shows an embodiment of a fissile signal transmission tube 10' in accordance with the present invention in which the rupture lines 20' are distributed about the center of the tube. Upon firing, the impulse in the tube will split the tube along the rupture lines into four separate longitudinal strands, as indicated in dotted outline. In addition to leaving a tube carcass that is less robust than an intact tube carcass, splitting the tube into strands accelerates the rate at which the carcass will be subject to environmental degradation due to the increase in tube surface area exposed. To illustrate, an intact tube carcass having an outer diameter of 0.118 inch (3.0 mm) and an inner diameter of 0.050 inch (1.27 mm), which therefore has 0.108 cubic inch of tube material per linear foot (5.8 $cm^3$/meter), has an exposed surface area of 4.4 square inches per linear foot. When the tube is split in half, as would be the tube shown in FIG. 2B, the exposed surface area increases to 8.0 square inches per linear foot. The tube of FIG. 2F, which is split into four strips, will have an exposed surface area of 9.6 square inches per linear foot (203 $cm^2$/meter). If the tube has eight radial weld seams, the exposed area will be 12.9 square inches per linear foot (273 $cm^2$/meter). Thus, it is seen that by increasing the number of longitudinal rupture lines, the exposed surface area of the tube carcass is increased. For example, the carcass split into eight strips has 2.9 times the surface area of an intact tube carcass so it can be expected to degrade 2.9 times as fast. The exposed surface area is greater still when serpentine rupture lines are used. Such increases in exposed surface area render the carcass more vulnerable to environmental degradation. However, it is well-known that polymeric materials generally exhibit resistance to environmental degradation so it will be advantageous to employ a material that degrades at an accelerated rate due to the inclusion of certain environmentally vulnerable additives, as discussed below.

Scoring means such as pins 124*a*, 124*b* may be orbited about the longitudinal center line of the parison or tube, for example, by causing fixture 122 to rotate or oscillate during the extrusion process to produce a weld seam having a serpentine configuration. (The term "orbiting" is used in the claims to mean either such rotation or oscillating movement of the scoring means.) If the fixture is rotated about the tube in a constant direction, the weld seam produced by the resulting orbiting of a pin on the fixture would assume a helical configuration, as indicated for weld seam 20*a* in FIG. 3. The rate at which the fixture rotates and the rate at which the tube is extruded through the fixture will determine the pitch of the helical configuration assumed by weld seam 20*a*. One measure of the pitch is the magnitude of angle $\alpha$ between weld seam 20*a* and imaginary longitudinal line 28 at the points 26*a*, 26*b*, etc., where they intersect. When an initiation signal passes through tube 10*a*, the pressure pulse will burst the tube along weld seam 20*a*, producing a carcass having a helically coiled configuration similar to that of a conventional telephone handset coiled cord. A tube carcass ruptured in this way is far more pliable than an intact tube carcass or one having a simple straight longitudinal rupture line, and is therefore less likely to inhibit the use of earth-moving equipment on a blasting site. In other embodiments the pin can oscillate about the tube, rotating first one way and then another, producing a sinusoidal or scallop-type serpentine weld seam.

Figure 3:
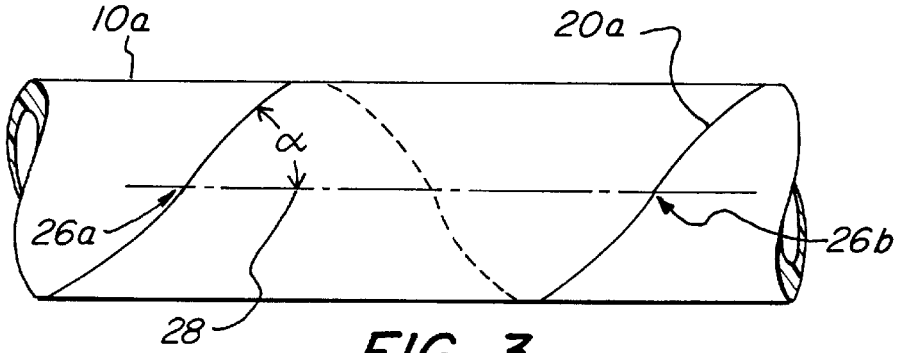
FIG. 3 is an elevational view of another embodiment of a shock tube according to the present invention.

With respect to the embodiment of FIG. 3, it is believed that a consequence of varying helical angle $\alpha$ is that as $\alpha$ increases, the hoop strength or bursting strength of the tube increases, reflecting a decrease in the tendency of the tube to rupture along weld seam 20*a* in response to a signal pulse, while the tensile strength of the tube decreases, reflecting an increase in the tendency of the tube to rupture along weld seam 20*a* in response to longitudinal tension. Conversely, as $\alpha$ is reduced, the bursting strength of the tube diminishes and the longitudinal tensile strength increases. The optimum angle $\alpha$ will balance the desirability of the tube to split along the weld seam and the need for a tube of satisfactory longitudinal tensile strength. Since it is generally preferred to minimize the amount of reactive material used in a shock tube and to preserve the longitudinal tensile strength of the tube, it is generally preferred to employ a weld seam having a moderate helical angle $\alpha$, e.g., 45° and to conduce longitudinal molecular orientation of the extrudate forming the tube wall.

Figure 4:
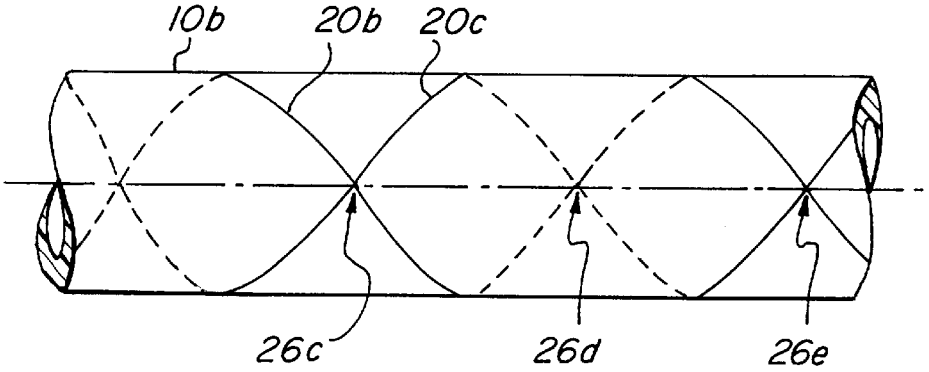
FIG. 4 is a view similar to that of FIG. 3 of yet another embodiment of a shock tube according to the present invention.
Figure 5:
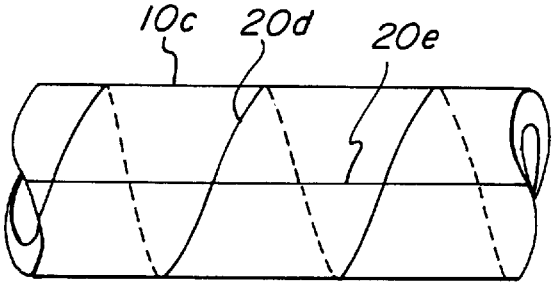
FIG. 5 is a view similar to that of FIG. 3 of still another embodiment of a shock tube according to the present invention.

Since the extrudate is still in fluid form when the weld seam is being formed in the parison as described above, the rotation in a single direction of a pin or other scoring means that penetrates the parison may impart a twist to the tube. To avoid this result, a second fixture comprising a pin that protrudes into the parison and that rotates in the opposite direction may be employed. Fissile signal transmission tube 10*b* shown in FIG. 4 illustrates an embodiment of the invention produced using two counter-rotating pins in the extrusion device to produce two counter-helical weld seams 20*b* and 20*c* which intersect each other at longitudinally spaced-apart intervals, e.g., at points 26*c,* 26*d* and 26*e;* points 26*c* and 26*e* being in the forefront of the Figure while point 26*d* is on the side of tube 10*b* not visible in the view of FIG. 4 and is therefore shown in dotted outline. Upon firing the tube, the pressure pulse will rupture tube 10*b* along both weld seams 20*b* and 20*c,* producing a plurality of roughly rectangular curvate shards. Alternatively, a helical weld seam 20*d* may be used in conjunction with a straight weld seam 20*e* as illustrated for tube 10*c* in FIG. 5. When the tube is fired, both helical weld seam 20*d* and straight longitudinal weld seam 20*e* will burst, and the tube will tend to break into crispate rhomboid shards.

Figure 6:
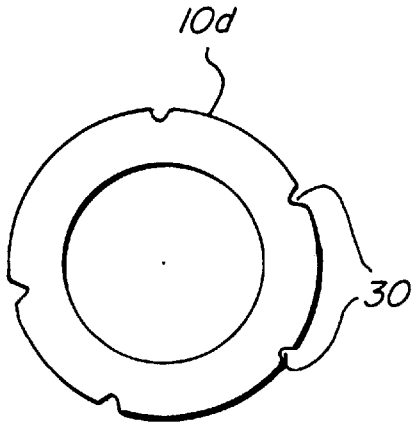
FIG. 6 is a cross-sectional end view of still another embodiment of the present invention.

In alternative embodiments, the scoring means may provide a rupture line in the form of one or more longitudinal grooves along which the thickness of the tube is reduced. The reduced thickness of the tube wall along the groove provides a region of reduced bursting strength along which the tube ruptures as the signal pulse passes therethrough. The one or more grooves may be disposed in the same configurations as described above for the weld seams, i.e., serpentine, helical, sinusoidal, intersecting, etc. To produce the grooves, the scoring means may comprise a ribbed or fluted extrusion die, e.g., a fluted ring die or a scoring tine that bears upon the surface of the parison to score the tube as it is being extruded, but which is configured not to allow the extrudate to reconverge to form a weld seam. Grooves may thus be formed on the exterior surface of the tube as illustrated in FIG. 6 where, in a particular embodiment, tube 10*d* is seen to have a plurality of grooves 30 on the outer wall of the tube. Optionally, the scoring means may comprise a laser for burning a groove into the exterior surface of the tube.

Figure 7:
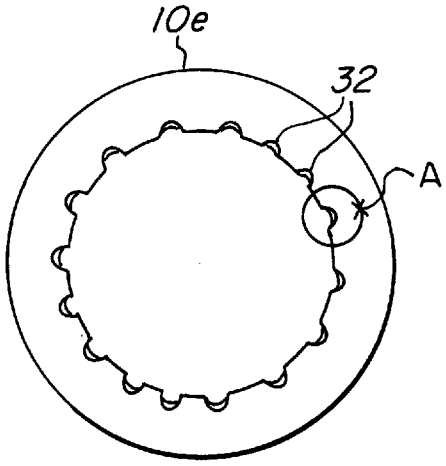
FIG. 7 is a view similar to FIG. 6 of another embodiment of shock tube according to the present invention.
Figure 8:
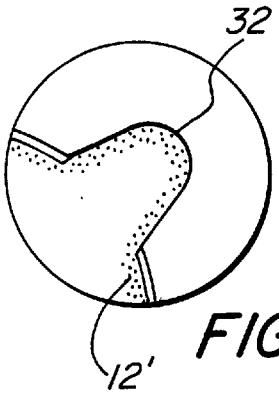
FIG. 8 is a view of the circular segment A of FIG. 7, but enlarged relative to FIG. 7, showing a single groove of the shock tube of FIG. 7.

In one embodiment of the invention, the rupture lines comprise grooves formed in the interior of the tube, as shown in tube 10*e* of FIG. 7, which has a plurality of internal longitudinal grooves 32, which may be formed by a ribbed pencil die. One of the grooves 32, designated 'A', is illustrated in an enlarged view in FIG. 8, where it can be seen that reactive material 12' is disposed on the interior surface of tube 10*e,* including within the groove.

Figure 9A:
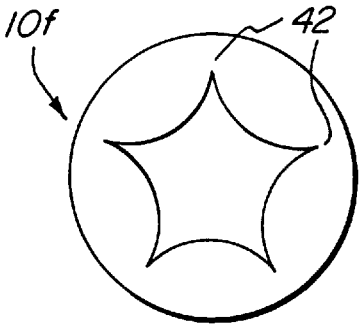
FIG. 9A is a cross-sectional view of a signal transmission tube having a fluted interior in accordance with another embodiment of the present invention.
Figure 9B:
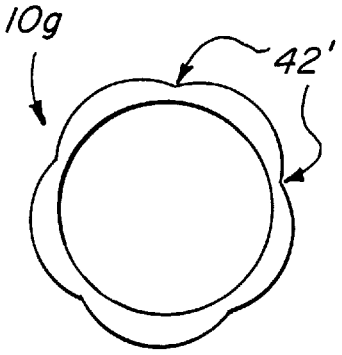
FIG. 9B is a cross-sectional view of a signal transmission tube having a fluted exterior in accordance with another embodiment of the invention.

Another way to produce a tube having grooves is to employ a fluted extrusion die so that the tube 10*f* has an interior that is fluted, as shown in FIG. 9A. When the reactive material therein is fired, the tube will split along the longitudinal rupture lines formed by the apices 42 of the flutes since the tube wall is weakest at those points. Similarly, fluting might be applied externally as on tube 10*g* (FIG. 9B) with the apices 42' pointing towards the tube interior.

Optionally, a conventional signal transmission tube can be treated to conform to the present invention by utilizing scoring means in a post-extrusion step. For example, the tube can be passed through a fixture comprising one or more knife blades disposed so that they cut into the tube wall as it passes through the fixture, leaving one or more longitudinal grooves in the tube and creating one or more lines of reduced wall strength where the tube will rupture upon firing. Similarly, an externally mounted laser may be used to create a rupture line in the tube.

The foregoing embodiments provide a signal transmission tube that leaves a carcass which is significantly less resilient and less strong than the carcass of conventional signal transmission tube. The carcass of signal transmission tube according to the present invention is either split open upon firing, preferably along a serpentine, more preferably helical, rupture line, or is split longitudinally, optionally along two or more non-intersecting rupture lines into two or more strips, or is preferably rendered into a plurality of shards or fragments by an intersecting pattern of rupture lines. In each instance, the strength and resiliency of the spent carcass is at least reduced in relation to a conventional spent tube carcass and, from the point of view of entanglement, eliminated altogether by being rendered into shards or fragments.

According to another aspect of the present invention the shock tube may comprise a material that is subject to more rapid degradation by physical and/or chemical environmental processes than conventional polymeric materials mentioned above. For example, the tube may comprise biodegradable material, i.e., material upon which environmental bacteria, fungi, or other biological agents act to cause degradation of the physical integrity of the tube carcass. One such material is EnviroPlastic™ material, which is manufactured by Planet Polymer Technologies, Inc., and which comprises an extrudate polymeric material that comprises starch. A signal transmission tube may be made with EnviroPlastic™ material and, when the tube carcass is left on the job site, biological agents such as certain fungi and/or bacteria can attack the starch, thus degrading the physical integrity of the tube carcass.

Similarly, the tube could be produced using a photodegradable material which degrades upon exposure to sunlight, thereby causing the tube carcass to degrade.

The effectiveness of both the biodegradable and photodegradable embodiments of signal transmission tube described above in accelerating the degradation of the tube carcass improves as the exposed surface area of the tube carcass increases. Accordingly, it is advantageous for the degradable materials described above to be used in fissile signal transmission tubes which have greater exposed surface areas after firing.

Figure 10:
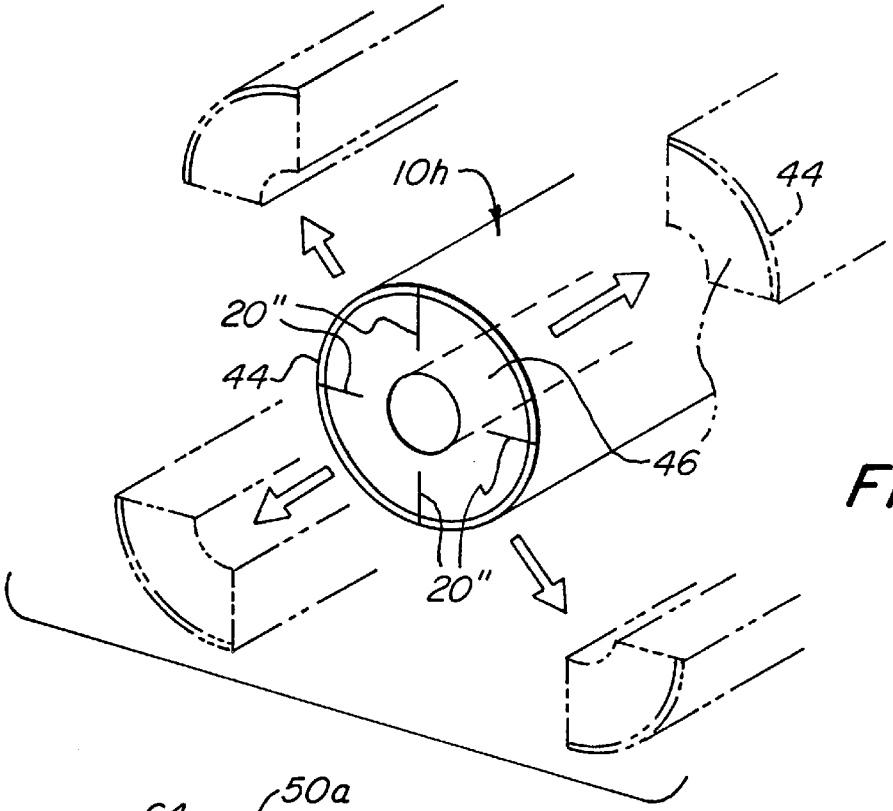
FIG. 10 is a partly cross-sectional perspective view of a fissile shock tube having an outer casing in accordance with yet another embodiment of the present invention.

To prevent premature degradation of the environmentally degradable tube, the tube may be covered with a thin, outer casing 44 as shown on tube 10*h* in FIG. 10. This coating may be applied by typical extrusion, co-extrusion or coating process.

Outer casing 44 comprises an environmentally impermeable material such as one of the conventional polymeric materials mentioned above. Outer casing 44 serves to protect the internal, biodegradable polymeric material from exposure to biological, physical or chemical agents that would cause tube 10*h* to suffer premature damage. As indicated above the biological agents may include fungi, bacteria and the like, and the physical agents may include light, especially ultraviolet light. Outer casing 44 will provide a physical barrier to these agents, and it may contain additives to enhance the protective function, e.g., a fungicide or a UV-blocking agent. Chemical agents may include water or, should the tube be used in conjunction with an ANFO (ammonium nitrate fuel oil) charge, oil. Preferably, weld seams 20" extend through outer casing 44 so that outer casing 44 splits with tube 10*h* to expose the environmentally degradable material. Alternatively, outer casing 44 may be, due to its chemical composition and/or physical configuration (i.e., thinness), subject to rupture with tube 10*h* even when it does not itself comprise a rupture line. Of course, the total exposed surface area of degradable material 46 of tube 10*h* is less than it would be without outer casing 44, but the exposed surface area will increase with increases in the number of longitudinal rupture lines (weld seams) as set forth above.

As indicated above, a signal transmission tube in accordance with the present invention may be produced by extruding a plurality of parallel tube segments in an annular configuration so that adjacent segments physically and/or chemically adhere to each other at the interfaces between them and are dimensioned and configured to define a tube wall. The interfaces between adjacent segments can provide longitudinally extending rupture lines along which the signal transmission tube splits as a signal passes therethrough. The plurality of tube segments may comprise a plurality of extrudate materials, i.e., some segments may optionally comprise an extrudate material that is different from the extrudate material of other segments.

Figure 11A:
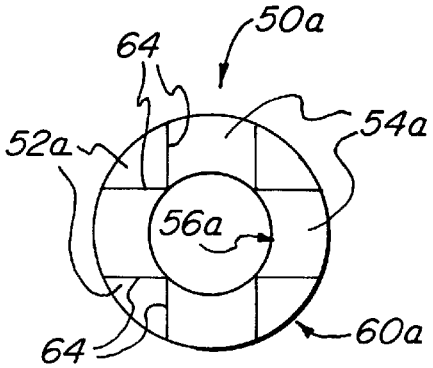
FIGS. 11A–11D are cross-sectional views of segmented signal transmission tubes according to various embodiments of the present invention.

FIG. 11A shows a cross section of a tube 50*a* that comprises a plurality of segments comprising a first plurality of segments 52*a* and a second plurality of segments 54*a*. Segments 52*a* are wedge-shaped with apices at the interior surface 56 of tube 50*a* and so do not define a substantial portion of interior surface 56*a* of tube 50*a*. Segments 52*a* define, however, a portion of exterior surface 60*a*. Each segment 54*a* has a pair of straight, parallel sides that are contiguous with the sides of segments 52*a*. Each segment 54*a* also has a concave side disposed towards the interior of tube 50*a* and together the concave sides of segments 54*a* define substantially the entire interior surface 56*a* of tube 50*a*. Each segment 54*a* also has a convex side disposed toward the exterior surface of tube 50*a* and, in cooperation with segments 52*a*, segments 54*a* define the exterior surface 60*a* of tube 50*a*. Segments 52*a* and 54*a* adhere to each other at their contiguous sides, i.e., at interfaces 64.

Figure 11B:
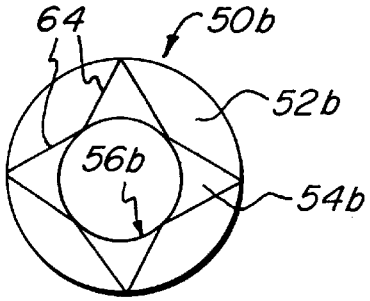

Like tube 50*a*, tube 50*b* (FIG. 11B) comprises two pluralities of segments, segments 52*b* and 54*b*. Segments 52*b* and 54*b* are dimensioned and configured so that segments 54*b* define substantially the entire interior surface 56*b* of tube 50*b*. Segments 52*b* are dimensioned and configured so that they define substantially the entire exterior surface of tube 50*b*.

Figure 11C:
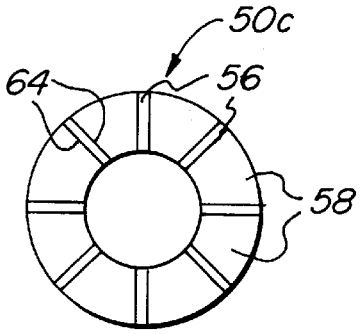

In accordance with yet another embodiment of the invention, FIG. 11C shows a tube 50*c* comprising a plurality of segments comprising a first plurality of minor segments 56 and a second plurality of major segments 58. In tube 50*c*, each segment defines a portion of the interior surface of tube 50*c* and a portion of the exterior surface.

Figure 11D:
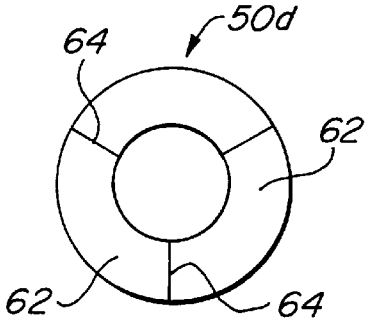

FIG. 11D shows a tube 50*d* that comprises merely three segments 62.

In the embodiments of FIGS. 11A, 11B, 11C and 11D, the pluralities of segments may comprise a single type of extrudate material, e.g., the plurality of segments 52*a* may comprise a single extrudate material which may be the same as the extrudate for the plurality of segments 54*a*.

Thus, segments 52*a* and 54*a* may all comprise high density polyethylene. In such case, the extruder may be configured and the extrusion conditions controlled so that when the two pluralities of segments 52*a* and 54*a* are extruded, they do not fully meld, and thus form longitudinal rupture lines at interfaces 64. In this case, interfaces 64 are similar to weld seams 20 (FIGS. 2C and 2D). Alternatively, at least some of segments 52*a* may comprise a different extrudate material from segments 54*a*. For example, since segments 54*a* define the interior surface 56*a* of tube 50*a*, at least some, preferably all, of segments 54*a* may comprise an extrudate material having good surface adhesion properties for the reactive material in the signal transmission tube. As is well-known in the art, polymeric ionomers such as those sold under the tradename SURLYN™, provide good adhesion for reactive materials on the inner surface of signal transmission tubes. Accordingly, segments 54*a* may comprise a SURLYN™ material while segments 52*a* may comprise some other extrudate material having other desirable properties, e.g., having tensile strength superior to that of a SURLYN™ material, e.g., high density polyethylene.

Optionally, a tube having rupture lines provided by interfaces between adjacent tube segments may also have one or more rupture lines obtained by inserting a pin or blade into the extrusion parison or by scoring the tube, as described above.

While the invention has been described in detail with respect to specific preferred embodiments thereof, it is to be understood that upon a reading of the foregoing description, variations to the specific embodiments disclosed may occur to those skilled in the art and it is intended to include such variations within the scope of the appended claims.

What is claimed is:

1. A method for making fissile signal transmission tube comprising:

extruding at least one extrudate material to form a tube comprising a tube wall having an inner surface which defines an interior longitudinal passageway of the tube;

forming at least one longitudinally extending rupture line in the tube wall along the entire length of the tube to provide a region of reduced bursting and tensile strength along the rupture line; and disposing reactive material within the interior longitudinal passageway of the tube in an amount sufficient to propagate an initiation signal therethrough and to rupture the tube along at least one rupture line.

2. The method of claim 1 wherein forming the at least one rupture line comprises forming at least one weld seam in the tube wall.

3. The method of claim 1 or claim 2 comprising forming the at least one longitudinally extending rupture line while extruding the at least one extrudate material to form the tube.

4. The method of claim 1 wherein forming the at least one rupture line comprises disposing scoring means in the flow path of the extrudate material and allowing the extrudate material to flow past the scoring means and to converge downstream of the scoring means to form a tube having a longitudinally extending weld seam.

5. The method of claim 4 further comprising facilitating the flow of the extrudate material past the scoring means by at least one of vibrating, heating or cooling the scoring means.

6. The method of claim 1 wherein forming the at least one longitudinally extending rupture line comprises forming at least one groove in the tube wall.

7. The method of claim 6 comprising forming at least one groove on the interior surface of the tube.

8. The method of claim 6 comprising forming at least one groove on the exterior surface of the tube.

9. The method of claim 1 comprising forming at least one serpentine rupture line in the tube wall.

10. The method of claim 3 wherein the tube has a centerline, further comprising orbiting the scoring means about the centerline of the tube to form the at least one serpentine rupture line.

11. The method of claim 1 comprising forming at least two longitudinally extending rupture lines in the tube wall.

12. The method of claim 11 comprising forming at least-two rupture lines that intersect at periodic, longitudinally spaced-apart intervals along the length of the tube.

13. The method of claim 1 wherein the tube comprises an environmentally degradable material.

14. The method of claim 13 further comprising disposing a protective outer casing on the exterior of the environmentally degradable material.

15. The method of claim 1 comprising extruding a plurality of tube segments in an annular configuration to form the tube, with adjacent tube segments adhering to each other at interfaces that provide the at least one rupture line.

16. The method of claim 15 comprising extruding a first plurality of tube segments and a second plurality of tube segments.

17. The method of claim 15 comprising extruding a first plurality of tube segments that are dimensioned and configured to define the interior surface of the tube and a second plurality of tube segments that define at least a portion of the exterior surface of the tube.

18. The method of claim 15, claim 16 or claim 17 comprising extruding at least two different extrudate materials.

19. A fissile signal transmission tube comprising:

a tube comprising a tube wall having an inner surface and at least one longitudinally extending rupture line formed in the tube wall along the entire length of the tube to provide a region of reduced bursting strength; and a reactive material disposed on the inner surface of the tube in an amount sufficient to propagate an initiation signal therethrough and to burst the tube along the at least one rupture line.

20. The signal transmission tube of claim 19 wherein the at least one rupture line has a serpentine configuration.

21. The signal transmission tube of claim 20 comprising at least two longitudinally extending rupture lines that intersect at periodic, longitudinally spaced-apart intervals along the length of the tube.

22. The signal transmission tube of claim 21 wherein the at least two longitudinally extending rupture lines have counter-rotating helical configurations.

23. The signal transmission tube of claim 19 wherein the at least one rupture line comprises a groove on the interior of the tube and comprising reactive material disposed in the groove.

24. The signal transmission tube of claim 19 wherein the tube comprises an environmentally degradable material.

25. The signal transmission tube of claim 24 further comprising an outer casing to protect the environmentally degradable material prior to firing.

26. The signal transmission tube of claim 19 comprising a plurality of tube segments adhered to each other at interfaces between them.

27. The signal transmission tube of claim 26 comprising a first plurality of tube segments that define substantially the entire interior surface of the tube and a second plurality of segments that define at least a portion of the exterior surface of the tube.

28. The signal transmission tube of claim 26 or claim 27 comprising segments comprising at least two different extrudate materials.

* * * * *

UNITED STATES PATENT AND TRADEMARK OFFICE

CERTIFICATE OF CORRECTION

PATENT NO. : 5,827,994
DATED : October 27, 1998
INVENTOR(S) : Ernest L. Gladden et al It is certified that error appears in the above-identified patent and that said Letters Patent is hereby corrected as shown below:

In column 5, line 24, replace "the-tube" with --the tube--.

In column 6, line 17, insert a period after "tube".

In column 13, claim 10, change the dependency from claim 3 to claim 4.

Signed and Sealed this

Eleventh Day of May, 1999

*Attest:*

Q. TODD DICKINSON

*Attesting Officer*

*Acting Commissioner of Patents and Trademarks*